US005676280A

United States Patent [19]

Robinson

[11] Patent Number: 5,676,280

[45] Date of Patent: Oct. 14, 1997

[54] ANTI CROSS-CONTAMINATION DUAL CARTRIDGE DISPENSER

[75] Inventor: Leonard R. Robinson, Danvers, Mass.

[73] Assignee: Illinois Tool Works Inc., Glenview, Ill.

[21] Appl. No.: 511,586

[22] Filed: Aug. 4, 1995

[51] Int. Cl.[6] ..... B67D 5/52

[52] U.S. Cl. ..... 222/137; 222/541.5; 222/562

[58] Field of Search ..... 222/94, 135–137, 222/129, 541.5, 562, 541.6, 541.9

[56] References Cited

U.S. PATENT DOCUMENTS

| | | | |
|---|---|---|---|
| 2,392,195 | 9/1946 | Shonnard . | |
| 2,742,202 | 4/1956 | Dresden et al. . | |
| 2,750,068 | 6/1956 | Platt, Jr. . | |
| 2,826,339 | 3/1958 | Maillard | 222/137 |
| 2,831,615 | 8/1958 | Sherbondy | 222/391 |
| 3,105,615 | 10/1963 | Koga | 222/94 |
| 3,187,966 | 6/1965 | Klygis . | |
| 3,204,835 | 9/1965 | Michel . | |
| 3,323,682 | 6/1967 | Creighton, Jr. et al. | 222/137 X |
| 3,669,310 | 6/1972 | Zuckheim . | |
| 3,685,514 | 8/1972 | Cheney . | |
| 3,703,898 | 11/1972 | Zackheim | 128/261 |
| 3,743,144 | 7/1973 | Marg et al. | 222/180 |
| 3,777,949 | 12/1973 | Chiquiari-Arias . | |
| 3,827,602 | 8/1974 | Nicholls | 222/137 |
| 3,828,980 | 8/1974 | Creighton et al. | 222/137 |
| 3,841,537 | 10/1974 | Marg et al. . | |
| 3,874,561 | 4/1975 | Zackheim et al. | 222/207 |
| 3,878,831 | 4/1975 | Zackheim . | |
| 3,882,866 | 5/1975 | Zackheim . | |
| 3,921,860 | 11/1975 | Zackheim | 222/207 |
| 3,945,381 | 3/1976 | Silver . | |
| 4,040,420 | 8/1977 | Speer . | |
| 4,153,056 | 5/1979 | Silver et al. . | |
| 4,159,066 | 6/1979 | Silver | 222/129 |
| 4,248,228 | 2/1981 | Silver . | |
| 4,260,077 | 4/1981 | Schroeder | 222/137 |
| 4,275,729 | 6/1981 | Silver et al. . | |
| 4,566,613 | 1/1986 | Anscomb . | |
| 4,765,518 | 8/1988 | O'Meara . | |
| 4,974,756 | 12/1990 | Pearson et al. . | |
| 4,989,758 | 2/1991 | Keller | 222/94 X |
| 5,221,029 | 6/1993 | Stull . | |
| 5,249,709 | 10/1993 | Duckworth | 222/137 |
| 5,290,259 | 3/1994 | Fischer . | |
| 5,335,827 | 8/1994 | Gentile | 222/137 |
| 5,577,636 | 11/1996 | Fukuoka et al. | 222/94 |

*Primary Examiner*—Kevin P. Shaver
*Attorney, Agent, or Firm*—Schwartz & Weinrieb

[57] ABSTRACT

The present invention is directed to an apparatus for dispensing a two-part adhesive. The apparatus includes a cartridge body having two vessels for containing separate liquid components, respectively. Each vessel has a corresponding nozzle with an orifice in fluid communication with the corresponding vessel. The apparatus also has a cap frangibly connected to the nozzles to seal the orifices prior to opening the vessels. The cap is constructed so that separation from the nozzles opens the orifices. Once disconnected, the cap is removably securable to the nozzles. The cap also has a receptacle that conforms to the profile of the nozzles to prevent cross-contamination of the liquid components.

20 Claims, 2 Drawing Sheets

ANTI CROSS-CONTAMINATION DUAL CARTRIDGE DISPENSER

FIELD OF THE INVENTION

The present invention generally relates to the field of dual compartment dispensers. In particular, the invention relates to dispensers used to mix two, otherwise separated, components for use.

BACKGROUND OF THE INVENTION

Dual compartment dispensers are available for separately containing liquid or flowable components that react when mixed. For example, one such compartment may contain an epoxy-based resin and the other compartment may contain a hardener. A dual plunger structure is manually compressed, dispensing the previously separated liquid adhesive components onto the work surface. The epoxy and hardener are mixed and react to form an adhesive that cures to form a strong bond.

Because it is desirable for the adhesive components to react quickly, it is important to prevent any unused liquid from mixing and reacting. That problem is known in the art as "cross-contamination." Cross-contamination is highly undesirable because at least a portion of the liquid contents are lost or wasted. Moreover, if the cross-contamination is severe enough, most or all of the entire contents of the dispenser may be lost. To save any remaining uncontaminated liquid, the hardened resin plugging the orifices must be cut away along with the orifice structure. That procedure is highly undesirable because the structure may be so damaged that it cannot be resealed, or reused, resulting in loss of any remaining or unused liquid.

Another disadvantage of prior dual compartment or cartridge dispensers is that the orifice structures themselves cause cross-contamination. Prior orifices are positioned so close together that the liquids, by design, mix immediately upon exiting their respective orifices. Such orifice structures are known in the art as "mix nozzles." Other dispensers employ a structure attachable to the orifice that combines the two exiting liquids into one stream. Such structures may facilitate mixing, however, the last-remaining liquid after an application is cross-contaminated. Such liquid will cure and harden, plugging the orifice and the associated channel.

Still other prior dual dispensers employ a cap or plug structure to reseal and to prevent the liquid contents from drying out and plugging the orifice. However, such cap structures fail to prevent cross-contamination because the cap can be secured to the dispenser "both ways." By "both ways" it is meant that the cap has identical portions for each dispenser chamber orifice. Thus, the cap can be secured over either of the orifices interchangeably. Because of such interchangability, the user will eventually inadvertently secure the cap both ways, causing cross-contamination through residual material held in the cap.

Another disadvantage of prior dual compartment dispensers is that, prior to the initial use, the orifices are sealed with cumbersome structures. Such structures include molded-in, plug-shaped seals that must be cut with a sharp metal object, such as a knife. Such non-frangible seals are cumbersome and potentially dangerous.

Hence, there exists a long-felt need for a dual cartridge dispenser that overcomes the disadvantages and problems in the prior devices as discussed above.

OBJECTS OF THE INVENTION

One object of the present invention is to provide an improved dual cartridge dispenser that is constructed to protect against cross-contamination of the liquid contents.

Another object of the present invention is to provide an improved dual cartridge dispenser in which a cap is replaceable on the nozzles in only one manner to avoid cross-contamination.

Yet another object of the present invention is to provide an improved dual cartridge dispenser where the cap is frangibly connected to the nozzles to seal the same prior to use, and to facilitate the opening of the dispenser without the use of tools.

SUMMARY OF THE INVENTION

The above-identified objects are met or exceeded by the present apparatus for dispensing a two-part adhesive. The apparatus includes a cartridge body having two vessels each containing respective liquid components. Each vessel has a corresponding nozzle that defines an orifice in fluid communication with the corresponding vessel.

The apparatus also includes a cap integrally formed with and frangibly connected to the nozzles. That connection seals the orifices prior to opening the vessels. The cap has an outer shell that is constructed to separate from the nozzles by twisting the cap, thus opening the orifices.

The cap also has a construction which prevents cross-contamination of the respective liquid components. Preferably, the nozzles each have a distinct profile, and the cap includes two receptacles, each configured to conform to a respective nozzle profile so that one receptacle can only engage one nozzle.

BRIEF DESCRIPTION OF THE DRAWINGS

Various other objects, features, and attendant advantages of the present invention will be more fully appreciated when considered in connection with the accompanying drawings in which like reference characters designate like or corresponding parts throughout the several views, and wherein.

DETAILED DESCRIPTION OF THE PREFERRED EMBODIMENT

Figure 1:
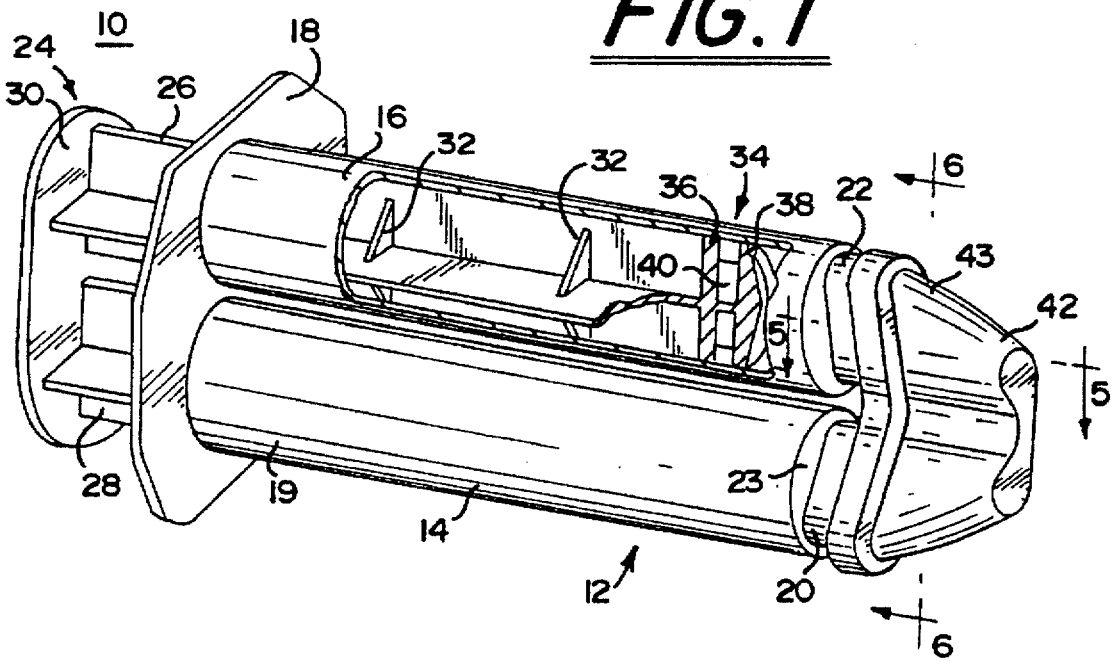
FIG. 1 is a perspective view of the dual cartridge dispenser of the present invention showing the cap secured to the nozzles, and including a partial cut-away section of the plunger disposed therein.
Figure 2:
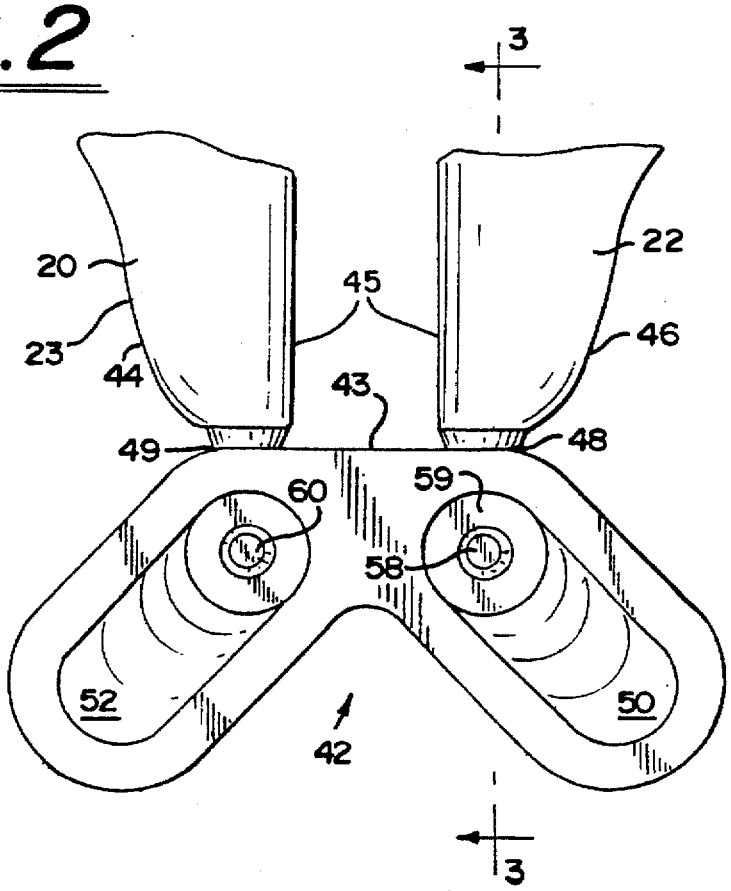
FIG. 2 is a fragmentary front view of the present dual cartridge dispenser showing the cap frangibly connected to the nozzles.

Referring now to FIGS. 1 and 2, the assembled dual cartridge dispenser of the present invention is generally designated 10 and includes a unitary cartridge body 12 having two generally cylindrical, hollow cartridges or vessels 14,16 and a transversely projecting body flange 18 located at a first end 19 of the body 12. Each vessel 14, 16 is provided with a corresponding liquid component, such as an epoxy resin in one vessel, and a hardener in the other. The cartridge body 12 also includes two nozzles 20,22 each in fluid communication with the vessels 14, 16 (best seen in FIG. 2). The nozzles 20, 22 are located at a second end 23 of the body 12 opposite the first end 19.

A unitary plunger 24 has a pair of parallel piston shafts 26,28 and a flange-like plunger activating bridging portion 30 disposed at one end of the plunger 24. In the preferred embodiment, the piston shafts 26,28 include support formations such as gussets 32.

At the ends of the shafts 26, 28 opposite from the bridging portion 30, each shaft 26,28 has a corresponding piston head assembly 34. The piston head assemblies 34 are substantially identical to each other, and each includes a pair of sealing rings 36,38 axially spaced by a shaft segment 40 of the corresponding shaft 26, 28. The construction and operation of unitary plunger 24 is provided in greater detail in commonly assigned U.S. Pat. No. 4,121,739 which is incorporated herein by reference.

Figure 3:
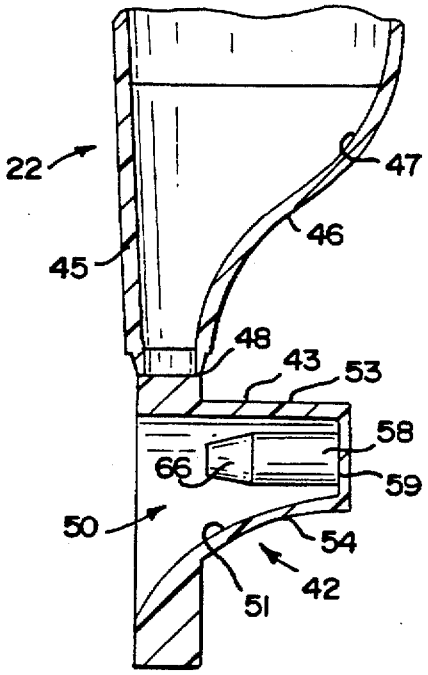
FIG. 3 is a cross-sectional view taken along the line 3—3 of FIG. 2 and in the direction indicated generally.
Figure 4:
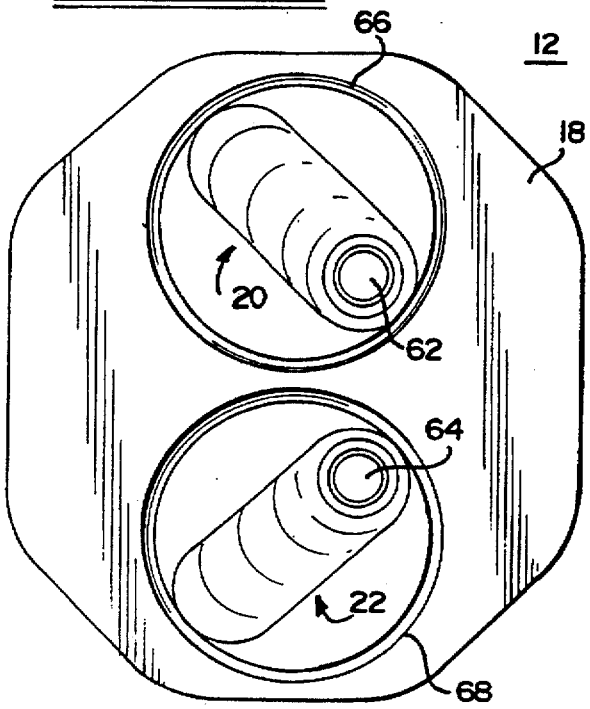
FIG. 4 is a bottom plan view of the present dual cartridge dispenser shown with the cap removed.

Referring now to FIGS. 1–3, a cap 42 is integrally formed with, and frangibly connected at an outer shell 43 to the ends of the nozzles 20,22. Each nozzle 20,22 has a curved profile 44,46 which is oblong and flattened when viewed from the bottom (best seen in FIG. 4) and, when viewed from the side with one generally straight wall portion 45 and one generally 'S' shaped wall portion 47 (best seen in FIG. 3). The nozzles 20,22 are constructed and arranged on the body 12 to be mirror images of each other. The cap 42 is configured to be disconnected from the nozzles 20,22 by manually breaking the frangible seals 48,49 formed therebetween.

Since the cartridge body 12 and the cap 42 are preferably molded as a single piece, it is important that the seals 48,49 are thick enough to permit the flow of liquid plastic through the mold to form the cap. At the same time, the seals 48,49 cannot be made too thick or they will lose their frangibility.

Figure 5:
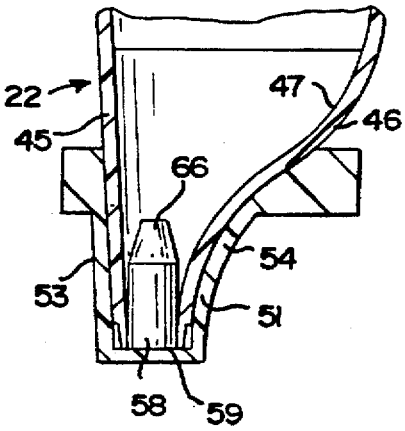
FIG. 5 is a fragmentary cross-sectional view taken along the line 5—5 of FIG. 1 and in the direction indicated generally.
Figure 6:
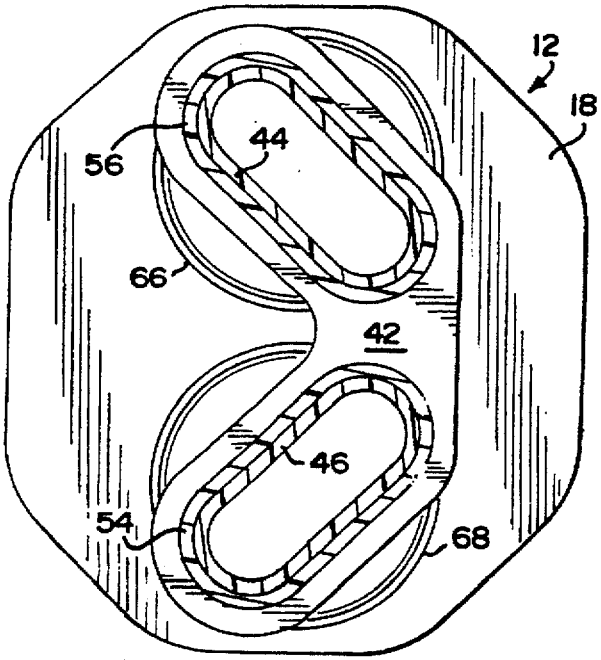
FIG. 6 is a fragmentary cross-sectional view taken along line 6—6 of FIG. 1 in the direction indicated generally.

The cap 42 includes two receptacles 50,52 each having a wall surface 54,56 defining an inner shape or profile. The wall surfaces 54,56 are also preferably mirror images of each other. The shape or profile of the wall surfaces 54,56 generally correspond to the respective nozzle profiles 44,46 as shown in FIGS. 5 and 6. The nozzle profiles 44,46 and the receptacle wall surface profiles 54,56 are configured to conform to each other so that the cap 42 is removably secured to, or engages, the nozzles 20,22.

The receptacles 50,52 are generally configured in a "V" shape, when viewed from the front of the dispenser 10 (best seen in FIG. 2). Also, the receptacles 50, 52 each have a generally S-shaped wall 51 corresponding to the curved wall portion 47 of the nozzles 20,22 and a straight wall 53 corresponding to the wall portion 45. The receptacle wall surface profiles 54,56 generally correspond to the nozzle profiles 44,46, which are also generally configured in a "V" shape (best shown in FIG. 6).

A prong 58,60 is located in each of the receptacles 50,52 and is preferably integrally joined at a base 59 of the cap 42. Each prong is dimensioned to matingly engage a corresponding orifice 62, 64 formed by the nozzles 20, 22 when the removal of the cap 42 breaks the seals 48, 49. It is preferred that the prongs 58,60 are disposed in the corresponding receptacles 50,52 near adjacent ends to create an "offset" or "cross-eyed" appearance (best seen in FIG. 2). The prongs 58,60 engage and seal the orifices 62,64 when the cap 42 is removed and releasably secured to the nozzles 20,22. In the preferred embodiment, tips 66,68 of the prongs 58,60 are tapered to facilitate entry into the orifices 62,64.

Referring now to FIG. 6, once the cap 42 is removably secured to the dual cartridge dispenser body 12, the nozzle profiles 44,46 fit and conform to the profile of the receptacle wall surfaces 54,56. To obtain this properly closed relationship, it is readily apparent that the cap 42 may only be removably secured to the nozzles 20,22 in the configuration shown. For example, the cap 42 could not be secured to nozzles 20,22 if the cap 42 was rotated 180° because the nozzle profiles 44,46 would not conform to the receptacle wall surface profiles 54,56. For that reason, cross-contamination of the liquid vessel contents is prevented.

In operation, the dispenser 10 is provided with the cap 42 in the position shown in FIGS. 2 and 3. Thus, the cap forms the seals of the nozzles 20, 22. To open the dispenser 10, the user merely twists the cap 42, which due to the frangible attachment at the seals 48, 49, radially breaks off, creating the orifices 62,64. The contents of the dispenser 10 may then be used by depressing the plunger 24. When closure is desired, the cap 42 (once disconnected) is rotated 90° from its position seen in FIG. 3 and is axially manipulated so that the receptacle wall surfaces 54,56 match the nozzle profiles 44,46 (best seen in FIGS. 5 and 6). In this position, the prongs 58, 60 are matingly engaged in the orifices 62,64.

While a particular embodiment of the anti cross-contamination dual cartridge dispenser of the invention has been shown and described, it will be appreciated by those skilled in the art that changes and modifications may be made thereto without departing from the invention in its broader aspects and as set forth in the following claims.

I claim:

1. Apparatus for dispensing a two-part mixture, comprising:

a cartridge body comprising a pair of vessels for containing first and second liquid components, respectively;

each one of said vessels having a nozzle defining a dispensing orifice in fluid communication with an interior portion of its respective vessel within which one of said first and second liquid components is contained;

a single cap integrally formed with both of said nozzles of said vessels so as to define frangible seals, upon first portions of said single cap, with said nozzles of said vessels for sealing said dispensing orifices of said nozzles prior to opening said vessels whereupon breakage of said frangible seals and separation of said single cap from said nozzles, said dispensing orifices of said nozzles are opened;

said single cap being removably securable upon said nozzles subsequent to separation of said single cap from said nozzles so as to be capable of repeatedly covering and resealing said dispensing orifices of said nozzles; and said single cap having orientation means defined upon second portions thereof for preventing cross-contamination of said first and second liquid components contained within said vessels by ensuring that when said single cap is secured upon said nozzles of said vessels so as to cover and reseal said dispensing orifices of said nozzles, said second portions of said single cap can only be secured upon said nozzles of said vessels in a single predetermined orientation whereby first and second sections of said single cap originally secured and sealed, respectively, upon first and second ones of said nozzles so as to cover and reseal first and second ones of said dispensing orifices of said first and second nozzles cannot be subsequently secured and sealed, respectively, upon said second and first ones of said nozzles so as to cover and reseal said second and first ones of said dispensing orifices of said second and first nozzles.

2. The apparatus of claim 1, wherein:

said orientation means for preventing said cross-contamination of said first and second liquid components comprises first and second receptacles defined within said first and second sections of said single cap and having predetermined configurations for removably securing said single cap only to said first and second ones of said nozzles, respectively.

3. The apparatus of claim 2, wherein:

said first and second receptacles each include a prong configured to matingly engage a respective one of said orifices of said vessels.

4. The apparatus of claim 3, wherein:

said orientation means having said predetermined configurations for preventing prevents said first prong of said first receptacle from being inserted into said second orifice of said second nozzle and said second prong of said second receptacle from being inserted into said first orifice of said first nozzle.

5. The apparatus of claim 3 wherein the first and second prongs each include a tapered tip to facilitate entry into the corresponding orifice.

6. The apparatus of claim 1, wherein:

said first and second nozzles each have a distinct profile; and said orientation means for preventing said cross-contamination of said first and second liquid components comprises first and second receptacles defined within said single cap which are configured to conform to the respective first and second profiles of said first and second nozzles so that said first receptacle cannot engage said second profile of said second nozzle and said second receptacle cannot engage said first profile of said first nozzle.

7. The apparatus of claim 2 wherein said receptacles define a general "V" shape with respect to each other.

8. The apparatus of claim 1, wherein:

said first portions of said single cap comprise outer shell portions frangibly connected to said first and second nozzles and adapted to be disconnected therefrom and rotated approximately 90° so as to place said second portions of said single cap having said orientation means defined thereon in engagement with said first and second nozzles.

9. The apparatus of claim 1, further comprising:

plunger means, having first and second pistons, disposed within said first and second vessels, respectively, for dispensing said first and second liquid components from said dispensing orifices of said nozzles.

10. The apparatus of claim 9, wherein:

said first liquid component is selected from a group comprising an epoxy, a rubber, and a silicone, and said second liquid component is selected from a group comprising an epoxy hardener, a rubber hardener, and a silicone hardener.

11. Apparatus for dispensing a two-part mixture, comprising:

a cartridge body comprising first and second vessels for containing first and second liquid components, respectively, wherein each one of said first and second vessels has a corresponding nozzle defining a dispensing orifice in fluid communication with an interior portion of its respective vessel within which one of said first and second liquid components is contained;

a single cap integrally formed with both of said nozzles of said vessels so as to define frangible seals, upon first portions of said single cap, with said nozzles of said vessels for sealing said dispensing orifices of said nozzles prior to opening said vessels whereupon breakage of said frangible seals and separation of said single cap from said nozzles, said dispensing orifices are opened, and wherein said single cap is removably securable upon said nozzles subsequent to said separation of said single cap from said nozzles so as to be capable of repeatedly covering and resealing said dispensing orifices of said nozzles; and orientation means, defined between second portions of said single cap and said nozzles of said vessels, for preventing cross-contamination of said first and second liquid components contained within said first and second vessels by ensuring that when said single cap is secured upon said nozzles of said vessels so as to cover and reseal said dispensing orifices of said nozzles, said second portions of said single cap can only be secured upon said nozzles of said vessels in a single predetermined orientation whereby first and second sections of said single cap originally secured and sealed, respectively, upon first and second ones of said nozzles so as to cover and reseal first and second ones of said dispensing orifices of said first and second nozzles cannot be subsequently secured and sealed, respectively, upon said second and first ones of said nozzles so as to cover and reseal said second and first ones of said dispensing orifices of said second and first nozzles.

12. The apparatus as set forth in claim 11, wherein said orientation means defined between said single cap and said nozzles of said vessels comprises:

said nozzles of said vessels have predetermined configurations; and said single cap comprises first and second receptacles formed therein which have predetermined configurations which substantially match said predetermined configurations of said nozzles such that said nozzles of said vessels can be received within said receptacles of said single cap.

13. The apparatus as set forth in claim 12, wherein:

said nozzles of said vessels have a predetermined angular orientation with respect to each other; and said first and second receptacles of said single cap have a predetermined angular orientation with respect to each other which is substantially the same as said predetermined angular orientation of said nozzles of said vessels.

14. The apparatus as set forth in claim 13, wherein:

said nozzles are oriented with respect to each other so as to define a substantially V-shaped configuration therebetween; and said first and second receptacles of said single cap are oriented with respect to each other so as to define a substantially V-shaped configuration therebetween.

15. The apparatus as set forth in claim 12, wherein:

said nozzles each have a predetermined external profile configuration; and said first and second receptacles of said single cap have predetermined internal profile configurations which substantially match said predetermined external profile configurations of said nozzles.

16. The apparatus as set forth in claim 11, wherein:

said first liquid component of said two-part mixture comprises an epoxy-based resin; and said second liquid component of said two-part mixture comprises a hardener.

17. Apparatus for dispensing a two-part mixture, comprising:

a cartridge body comprising first and second vessels for containing first and second liquid components, respectively;

each one of said first and second vessels having a nozzle defining a dispensing orifice which is in fluidic communication with an interior portion of its respective vessel within which one of said first and second liquid components is to be contained; and a single cap integrally formed with both of said nozzles of said vessels so as to define frangible seals with said nozzles of said vessels for sealing said dispensing orifices of said nozzles prior to opening said vessels whereupon breakage of said frangible seals and separation of said single cap from said nozzles, said dispensing orifices of said nozzles are opened;

said single cap being removably securable upon said nozzles subsequent to separation of said single cap from said nozzles so as to be capable of repeatedly covering and resealing said dispensing orifices of said nozzles, said nozzles each having a distinct profile, and said single cap having means for preventing cross-contamination of said first and second liquid components to be contained within said vessels wherein said preventing means comprises first and second receptacles defined within said single cap which are configured so as to conform to said distinct profiles of said nozzles whereby said first receptacle can only engage a first one of said nozzles having a first distinct profile and cannot engage a second one of said nozzles having a second distinct profile while said second receptacle can only engage said second one of said nozzles having said second distinct profile and cannot engage said first one of said nozzles having said first distinct profile.

18. Apparatus as set forth in claim 17, wherein:

said first and second nozzles are disposed at a predetermined angular orientation with respect to each other; and said first and second receptacles of said single cap are also disposed at a predetermined angular orientation with respect to each other which also substantially matches said predetermined angular orientation of said nozzles whereby said nozzles are able to be received within said receptacles of said single cap.

19. Apparatus as set forth in claim 18, wherein:

said nozzles and said receptacles are disposed in a substantially V-shaped configuration with respect to each other.

20. The apparatus as set forth in claim 17, wherein:

said first liquid component of said two-part mixture comprises an epoxy-based resin; and said second liquid component of said two-part mixture comprises a hardener.

* * * * *